US011583873B2

(12) United States Patent
Kuffel et al.

(10) Patent No.: US 11,583,873 B2
(45) Date of Patent: Feb. 21, 2023

(54) SPRINKLER HEAD WITH VANE DEFLECTOR

(71) Applicant: Tyco Fire Products LP, Lansdale, PA (US)

(72) Inventors: Travis W. Kuffel, Marinette, WI (US); Stephen A. Barker, Menominee, MI (US); Donald Bjorkman, Menominee, MI (US)

(73) Assignee: TYCO FIRE PRODUCTS LP, Lansdale, PA (US)

( * ) Notice: Subject to any disclaimer, the term of this patent is extended or adjusted under 35 U.S.C. 154(b) by 282 days.

(21) Appl. No.: 16/853,858

(22) Filed: Apr. 21, 2020

(65) Prior Publication Data

US 2020/0338577 A1 Oct. 29, 2020

Related U.S. Application Data

(60) Provisional application No. 62/837,278, filed on Apr. 23, 2019.

(51) Int. Cl.
*B05B 3/04* (2006.01)
*A62C 35/68* (2006.01)

(52) U.S. Cl.
CPC ..... *B05B 3/0486* (2013.01); *A62C 35/68* (2013.01)

(58) Field of Classification Search
CPC ..... B05B 3/0486; A62C 35/68
USPC ..... 169/37
See application file for complete search history.

(56) References Cited

U.S. PATENT DOCUMENTS

| | | | | |
|---|---|---|---|---|
| 3,180,422 | A * | 4/1965 | Kelley | A62C 35/605 169/37 |
| 4,580,729 | A * | 4/1986 | Pounder | A62C 37/12 239/524 |
| 7,201,234 | B2 * | 4/2007 | Rogers | A62C 31/02 239/524 |
| 8,720,592 | B2 | 5/2014 | Hubert et al. | |
| 9,352,176 | B2 | 5/2016 | Erva et al. | |
| 2020/0316418 | A1 | 10/2020 | Bjorkman et al. | |
| 2020/0316420 | A1 | 10/2020 | Morrison et al. | |

FOREIGN PATENT DOCUMENTS

| | | | |
|---|---|---|---|
| CA | 3031204 | A1 | 2/2018 |
| WO | WO-2020/128799 | A2 | 6/2020 |

* cited by examiner

*Primary Examiner* — Christopher S Kim
(74) *Attorney, Agent, or Firm* — Foley & Lardner LLP

(57) ABSTRACT

A sprinkler includes an inlet aperture, an outlet aperture, a body, a conical member, and a deflector. The inlet aperture receives fire suppressant agent at an inlet end of the sprinkler and the outlet aperture is at an outlet end of the sprinkler. The body extends along a longitudinal axis and includes an inner volume forming a fluid flow path between the inlet end and the outlet end of the sprinkler. The conical member is positioned at the outlet end of the sprinkler directs the fire suppressant agent outwards. The deflector receives fire suppressant agent from the conical member and distributes the fire suppressant agent about a service area. The deflector includes multiple tines, which each extend along a corresponding radial axis that is substantially perpendicular with the longitudinal axis. Each tine is offset by an angular amount about the corresponding radial axis.

10 Claims, 8 Drawing Sheets

SPRINKLER HEAD WITH VANE DEFLECTOR

CROSS-REFERENCE TO RELATED PATENT APPLICATION

This application claims the benefit of and priority to U.S. Provisional Patent Application No. 62/837,278, filed Apr. 23, 2019, the entire disclosure of which is incorporated by reference herein.

BACKGROUND

Fire suppression systems are commonly used to protect an area and objects within the area from fire. Fire suppression systems can be activated manually or automatically in response to an indication that a fire is present nearby (e.g., an increase in ambient temperature beyond a predetermined threshold value, etc.). Once activated, fire suppression systems spread a fire suppressant agent throughout the area. The fire suppressant agent then extinguishes or prevents the growth of the fire. Various sprinklers, nozzles, and dispersion devices are used to disperse the fire suppressant agent throughout the area.

SUMMARY

One implementation of the present disclosure is a sprinkler configured to distribute a fire suppressant agent. In some embodiments, the sprinkler includes an inlet aperture, an outlet aperture, a body, a conical member, and a deflector. In some embodiments, the inlet aperture is configured to receive fire suppressant agent at an inlet end of the sprinkler. In some embodiments, the outlet aperture is at an outlet end of the sprinkler. In some embodiments, the body extends along a longitudinal axis. In some embodiments, the body includes an inner volume forming a fluid flow path between the inlet end and the outlet end of the sprinkler. In some embodiments, the conical member is positioned at the outlet end of the sprinkler and configured to direct the fire suppressant agent outwards. In some embodiments, the deflector is configured to receive fire suppressant agent from the conical member and distribute the fire suppressant agent about a service area. In some embodiments, the deflector includes multiple tines. In some embodiments, each of the multiple tines extends along a corresponding radial axis that is substantially perpendicular with the longitudinal axis and extends radially outwards from the longitudinal axis. In some embodiments, each tine is offset by an angular amount about the corresponding radial axis.

In some embodiments, the deflector is fixedly coupled with the conical member at a base of the conical member and the multiple tines are configured to receive the fire suppressant agent and direct the fire suppressant agent radially outwards to distribute the fire suppressant agent about the service area.

In some embodiments, the deflector is rotatably coupled with the conical member at a base of the conical member.

In some embodiments, the multiple tines of the deflector are configured to receive the fire suppressant agent as the fire suppressant agent flows along the fluid flow path to drive the deflector to rotate about the longitudinal axis.

In some embodiments, the conical member is configured to receive the fire suppressant agent from the outlet aperture of the sprinkler at the outlet end of the sprinkler and distribute the fire suppressant agent about the deflector.

In some embodiments, the deflector further includes multiple slots. In some embodiments, each slot is positioned between neighboring tines.

In some embodiments, the multiple tines are each angled between 1 and 45 degrees about the corresponding radial axis.

In some embodiments, the multiple tines are each twisted about the corresponding radial axis.

In some embodiments, the conical member is fixedly coupled with a connecting portion of the sprinkler at an apex of the conical member. In some embodiments, the connecting portion is fixedly coupled with and extends between two points of the body at the outlet end of the sprinkler.

In some embodiments, the conical member and the deflector are positioned downstream of the outlet aperture of the sprinkler.

Another implementation of the present disclosure is a fire suppression system. In some embodiments, the fire suppression system includes a tank, a piping system, and a discharge device. In some embodiments, the tank is configured to store a fire suppressant agent. In some embodiments, the piping system is fluidly coupled with the tank. In some embodiments, the discharge device is fluidly coupled with the piping system. In some embodiments, the discharge device includes a body, a splitter, and a deflecting member. In some embodiments, the discharge device extends along a longitudinal axis and includes an inner volume configured to receive the fire suppressant agent from the piping system. In some embodiments, the inner volume forms a fluid flow path between an inlet end and an outlet end of the discharge device. In some embodiments, the splitter is positioned at the outlet end of the discharge device. In some embodiments, the splitter is configured to direct the fire suppressant agent outwards as the fire suppressant agent exits the body. In some embodiments, the deflecting member is rotatably coupled with a base of the splitter at the outlet end of the discharge device. In some embodiments, the deflecting member is configured to receive the fire suppressant agent that is directed outwards by the splitter, be driven to rotate about the longitudinal axis by a flow of the fire suppressant agent along the fluid flow path, and distribute the fire suppressant agent about an area.

In some embodiments, the deflecting member includes multiple tines. In some embodiments, each of the multiple tines extend along a corresponding radial axis. In some embodiments, the corresponding radial axis is substantially perpendicular with the longitudinal axis.

In some embodiments, each of the multiple tines are offset about the corresponding radial axis an angular amount.

In some embodiments, the angular amount is between 1 and 45 degrees.

In some embodiments, each of the multiple tines are twisted about the corresponding radial axis.

In some embodiments, the multiple tines of the deflecting member are configured to receive the fire suppressant agent so that the deflecting member is driven to rotate relative to the splitter by the flow of the fire suppressant agent.

In some embodiments, the deflecting member further includes multiple slots. In some embodiments, each of the multiple slots are positioned between neighboring ones of the multiple tines.

In some embodiments, the splitter is a conical member and the deflecting member is rotatably coupled with the conical member at a base of the conical member. In some embodiments, an apex of the conical member is positioned along the fluid flow path.

Another implementation of the present disclosure is a discharge device for a fire suppression system. In some embodiments, the discharge device includes a body, a connecting portion, a conical member, and a deflector. In some embodiments, the body extends along a longitudinal axis and includes an inlet end having an inlet aperture and an outlet end having an outlet aperture. In some embodiments, the body has an inner volume that defines a flow path between the inlet aperture and the outlet aperture. In some embodiments, the connecting portion extends across the outlet aperture. In some embodiments, the connecting portion is integrally formed with the body. In some embodiments, the conical member is integrally formed with the connecting portion. In some embodiments, an apex of the conical member is centered at the longitudinal axis and positioned along the flow path. In some embodiments, the deflector is coupled with a base of the conical member and positioned along the flow path downstream of the conical member. In some embodiments, the deflector includes multiple tines. In some embodiments, each tine extends radially outwards along a corresponding radial centerline that is perpendicular with the longitudinal axis and each tine is angularly offset about the corresponding radial centerline by an angular amount. In some embodiments, the conical member is configured to receive fire suppressant agent that flows along the flow path and direct the fire suppressant agent outwards towards the deflector.

In some embodiments, the deflector is rotatably coupled with the base of the conical member and the multiple tines are configured to receive the fire suppressant agent as the fire suppressant agent flows along the flow path. In some embodiments, the flow of the fire suppressant agent drives the deflector to rotate about the longitudinal axis and the multiple tines are configured to distribute the fire suppressant agent at least partially radially outwards.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Overview

Referring generally to the FIGURES, a sprinkler includes a body, a splitter (e.g., a conical splitter, a conical member, etc.), and a deflector/distributer. The sprinkler receives fire suppressant agent via an inlet at an inlet end, and outputs aerated fire suppressant agent at an outlet end. The sprinkler may receive air at the inlet end via air inlets and mix the fire suppressant agent and the air within an inner volume of the body. The splitter is configured to direct, diffuse, spread, etc., the fire suppressant agent exiting the sprinkler evenly about the deflector. The deflector includes multiple tines and slits. The deflector may be rotatably or fixedly coupled to the splitter. The deflector is configured to distribute, sprinkle, accelerate, etc., the fire suppressant agent. The flow of the fire suppressant agent can cause the deflector to rotate, if the deflector is rotatably coupled to the splitter, and the rotation of the deflector can facilitate increased spread/service area of the sprinkler. The shape, size, angles, and number of the tines can be adjusted to achieve a desired degree of spread (e.g., spread area or service area) of the fire suppressant agent exiting the sprinkler. Additionally, the shape, size, and number of slits/slots of the deflector can be adjusted to achieve a desired spread, foam quality, or service area of the sprinkler.

Fire Suppression System

Figure 1:
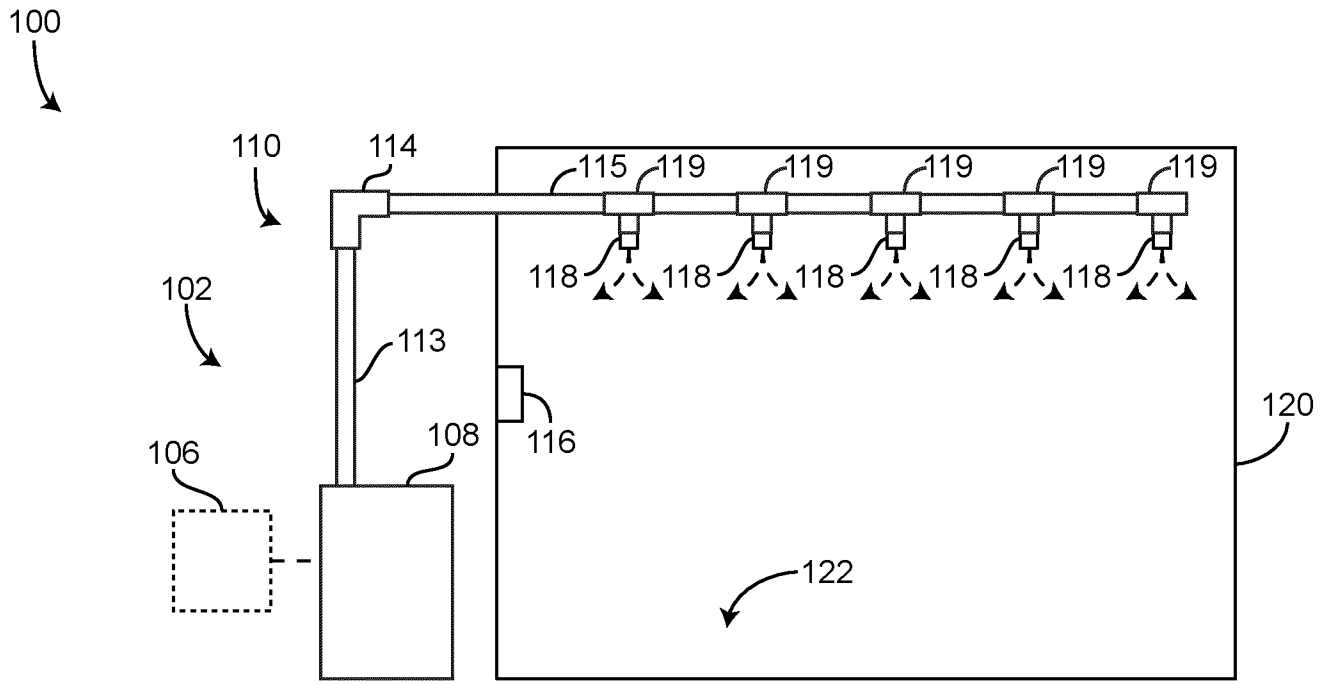
FIG. 1 is a schematic of a fire suppression system including multiple sprinklers which distribute a fire suppressant agent over an area, according to an exemplary embodiment.

Referring to FIG. 1, a fire suppression system 100 is shown, according to an exemplary embodiment. Fire suppression system 100 includes an activation and delivery system 102, and a piping system 110. Activation and delivery system 102 may include a tank, a container, a canister, etc., shown as tank 108 configured to store fire suppressant agent therewithin. Tank 108 can be fluidly coupled with piping system 110 and can provide the fire suppressant agent to piping system 110. Activation and delivery system 102 may include a prime mover (e.g., a pump, a compressor, a fan, a motor, etc.), configured to deliver fire suppressant agent to piping system 110. The prime mover can be fluidly coupled with the reservoir that contains the fire suppressant agent via a pipe, hose, tube, tubular member, etc. Fire suppression system 100 is configured to suppress a fire at area 122 within space 120. Space 120 may be a room of a building, an oven, a vehicle, a duct, etc., or any other device, system, area, or space at which a fire may occur. In an exemplary embodiment, space 120 is a room of a building.

Activation and delivery system 102 is configured to provide the fire suppressant agent from tank 108 containing the fire suppressant agent to piping system 110. Piping system 110 may include any plumbing components such as T-connectors 119, pipes 113/115, tubes, elbow connectors 114, nipple connectors, etc. Piping system 110 includes pipe 115 which extends through space 120 or above area 122 for which fire suppression is desired. Pipe 115 is fluidly coupled with multiple sprinklers, nozzles, discharge devices, dispersion devices, etc., shown as sprinklers 118. Sprinklers 118 are configured to receive the fire suppressant agent from pipe 115 and deliver (e.g., sprinkle, diffuse, spread, spray, etc.) the fire suppressant agent to area 122 and space 120. Sprinklers 118 may be pendant sprinklers configured to hang above area 122. In other embodiments, sprinklers 118 are upright sprinklers configured to protrude upwards from area 122. In other embodiments, sprinklers 118 are side discharge nozzles that are configured to be mounted/connected on the wall and protrude outwards from the wall.

Activation and delivery system 102 may be controlled by controller 106, depending on the type of activation and delivery system 102 used, according to an exemplary embodiment. Controller 106 may include a processing circuit, a processor and memory. Controller 106 may be configured to receive input information from a sensor 116 to determine if fire suppression system 100 should be activated. Controller 106 may use a fire detection algorithm to process any received sensory information. Sensor 116 may be or include a plurality of sensors. The plurality of sensors may be configured to measure values of various variables which are associated with and relevant to fire detection. For example, sensor 116 may be or include any of one or more temperature sensors, pressure sensors, light sensors, fire alarms, etc. Sensors 116 may be configured to measure various conditions within space 120 or within piping system 115. Activation and delivery system 102 may be configured to increase a pressure of piping system 110 such that fire suppressant agent is provided to sprinklers 118. In some embodiments, activation and delivery system 102 is configured to activate in response to a mechanical or manual activation. For example, activation and delivery system 102 can use a fusible link or a glass bulb to activate.

Activation and delivery system 102 may be configured to provide fire suppressant agent to piping system 110 using any of bladder tanks, compressed gas, municipal water pressure, etc. Activation and delivery system 102 can be any system configured to provide fire suppressant agent from one or more storage devices (e.g., storage tanks) to piping system 110 for fire suppression purposes. Tank 108 can be or include, but is not limited to, bladder tanks, premix tanks, municipal water supply, etc. For example, activation and delivery system 102 may include a tank having a compressed gas configured to drive the fire suppressant agent to sprinklers 118. Activation and delivery system 102 may use any of or a combination of a compressed gas, municipal water, a bladder tank, a prime mover, etc., to provide the fire suppressant agent to sprinklers 118. The fire suppressant agent may be water, an expandable foam, a non-fluorinated foam, a fluorinated foam, etc., or any other agent that can be used to suppress a fire. Activation and delivery system 102 can be any form of delivery system (e.g., a bladder tank system, a pump system, a pre-mix system, etc.) configured to provide the fire suppressant agent to sprinklers 118.

Fire suppression system 100 may be either a wet sprinkler system or a dry sprinkler system. For example, if fire suppression system 100 is a wet sprinkler system, piping system 110 contains a liquid (e.g., the fire suppressant agent) therewithin before sprinklers 118 are actuated to an open position for fire suppression. Wet sprinkler systems are often used when space 120 and/or piping system 110 are not exposed to low temperatures and are therefore not at a risk of freezing. If fire suppression system 100 is a dry sprinkler system, piping system 110 (or any pipes downstream of activation and delivery system 102) do not include the fire suppressant agent or liquid until it is determined that fire suppression system 100 should be activated. If fire suppression system 100 is a dry sprinkler system, air or a gas is present in piping system 100 upstream of activation and delivery system 102. When a pressure of the air or gas changes such that it is below a threshold value (e.g., due to one of sprinklers 118 activating), activation and delivery system 102 activates to provide piping system 110 and sprinklers 118 with the fire suppressant agent. The fire suppressant agent of fire suppression system 100 may be a liquid, a gas, a foam, user input devices, etc. For example, the fire suppressant agent may be water. In other embodiments, the fire suppressant agent is a non-fluorinated foam. In some embodiments, the fire suppressant agent is an expandable foam or a fluorinated foam. If fire suppression system 100 is configured to deliver a foam, one or more components of fire suppression system 100 may be configured to aerate the foam. For example, any of the connectors (e.g., elbow connector 114) may be configured to aerate the foam before it is provided to sprinklers 118. Likewise, sprinklers 118 may be configured to aerate the foam before the aerated foam is provided to area 122 of space 120 for fire suppression. In other embodiments, one or more aerating devices are provided along piping system 100 to aerate the foam. In some embodiments, sprinkler 118 are configured to aerate the foam/the fire suppressant agent.

Sprinklers

Referring to FIGS. 2-5 and 10, one of sprinklers 118 is shown in greater detail, according to various exemplary embodiments. Sprinkler 118 is configured to receive the fire suppressant agent from piping system 110 and sprinkle, diffuse, spread, spray, etc., the fire suppressant agent about an area (e.g., area 122 as shown in FIG. 1). Sprinkler 118 is configured to aerate the fire suppressant agent. Advantageously, if the fire suppressant agent is a foam, aeration aids in the delivery of the foam to the area, and/or the fire-suppressing properties of the foam. Sprinkler 118 is configured to sealingly and fluidly (e.g., via a threaded pipe connector) connect with piping system 110 to receive the fire suppressant agent. Sprinkler 118 may be configured to disperse the fire suppressant agent about an area in an overall conical shape. Sprinkler 118 may be coupled (e.g., integrally formed, fixedly, etc.) with a connector 146 (e.g., a connecting portion, a connection portion, an extending member, etc.).

Figure 2:
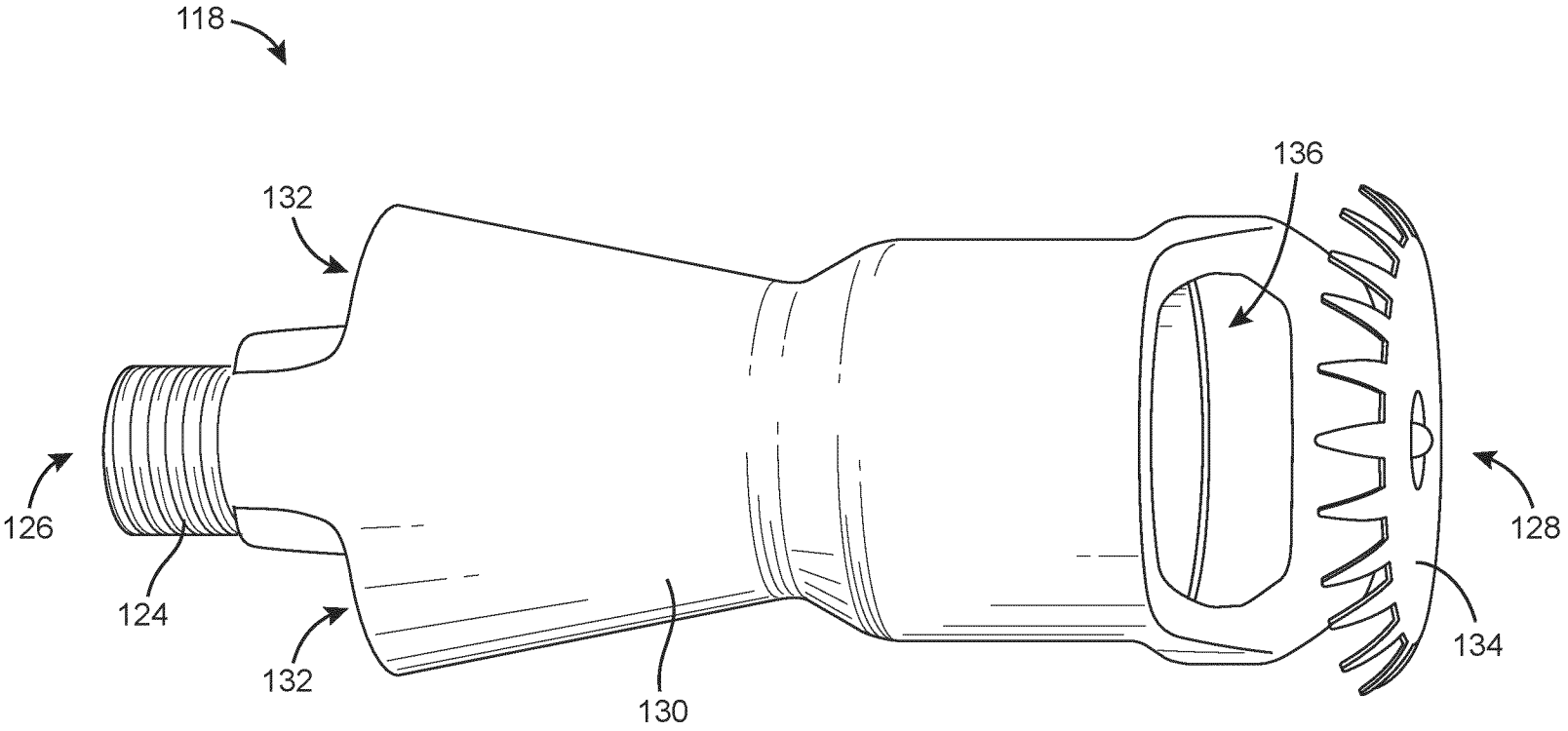
FIG. 2 is a side view of one of the sprinklers of FIG. 1, according to some embodiments.

Referring to FIG. 2, sprinkler 118 includes inlet end 126 and outlet end 128. Outlet end 128 is opposite inlet end 126. Sprinkler 118 receives fire suppressant agent at inlet end 126 and outputs the fire suppressant agent at outlet end 128. Inlet end 126 includes inlet 124. Inlet 124 is configured to fluidly couple sprinkler 118 with piping system 110. In an exemplary embodiment, inlet 124 is a threaded pipe configured to threadingly and fluidly interface with a connector of piping system 110. Inlet 124 includes an inner volume configured to facilitate the flow of fire suppressant agent therewithin. In some embodiments, inlet end 126 includes an orifice 156 (e.g., an opening, a hole, etc.) having diameter 125. In some embodiments, orifice 156 is disposed within inlet 124. Diameter 125 of orifice 156 controls the K-factor of sprinkler 118. For example, the K-factor of sprinkler 118 can be changed (e.g., increased or decreased) by adjusting diameter 125 of orifice 156 (or by adjusting a shape, area, etc., of orifice 156).

Figure 3:
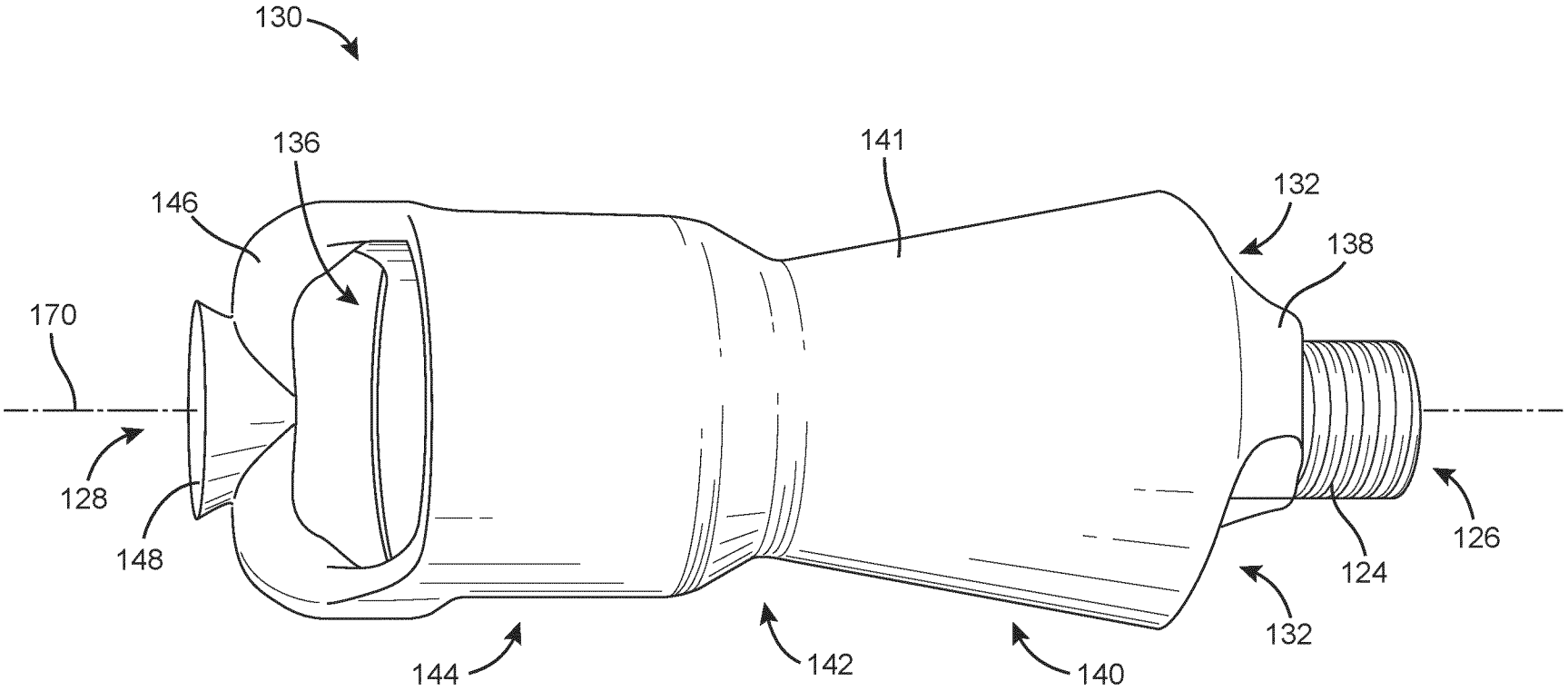
FIG. 3 is a side view of one of the sprinklers of FIG. 1, according to some embodiments.

Sprinkler 118 includes body 130, fluidly coupled to inlet 124. Body 130 may form a fluid flow path between inlet end 126 and outlet end 128. Body 130 includes an inner volume, an inner channel, etc., configured to facilitate the flow of fire suppressant agent therethrough (e.g., from inlet end 126 to outlet end 128, or from inlet 124 to outlet apertures 136). Body 130 includes air inlet 132 at inlet end 126 of body 130. Body 130 includes outlet aperture 136 at outlet end 128 of body 130. Body 130 is configured to deliver the fire suppressant agent to a distributer, a sprinkler, a vane deflector, a spreader, a deflecting member, etc., shown as deflector 134. Deflector 134 is configured to guide, diffuse, direct, etc., the fire suppressant agent received from outlet aperture 136 to distribute, sprinkle, etc., the fire suppressant agent about area 122 of space 120. Deflector 134 may be configured to expand the fire suppressant agent (e.g., aerated fire suppressant agent, aerated foam, etc.) or augment the fire suppressant agent and distribute the expanded fire suppressant agent to a desired range. For example, deflector 134 may facilitate the conical distribution of the fire suppressant agent about area 122 of space 120 or about any other area to which sprinkler 118 is configured to deliver fire suppressant agent. Deflector 134 may be configured to increase an area over which the fire suppressant agent is provided by sprinkler 118. Deflector 134 may be configured to receive fire suppressant agent deflected by another deflector (i.e., splitter 148 as shown in FIG. 3) and accelerate or direct the fire suppressant agent radially outwards from sprinkler 118 at outlet end 128. In some embodiments, connector 146 is coupled (e.g., integrally formed) at an apex of the overall conical shape of splitter 148. Deflector 134 is described in greater detail below.

Referring to FIGS. 2-5, body 130 is shown in greater detail, according to an exemplary embodiment. Body 130 includes wall 141, having a thickness 143 (see FIGS. 4-5). Wall 141 may have a uniform thickness 143 across body 130. In other embodiments, wall 141 has a variable thickness 143 (e.g., wall 141 is thicker at certain portions than others). If wall 141 has a uniform thickness 143, the shape of body 130 as viewed from the outside corresponds to the shape of the inner volume of body 130.

Body 130 includes a compression portion 140, a constricted portion 142, and an expansion portion 144. Compression portion 140, constricted portion 142, and expansion portion 144 form a venturi therewithin. Each of compression portion 140, constricted portion 142, and expansion portion 144 may have a wall thickness 143 and an inner volume defined therewithin to facilitate the flow of the fire suppressant agent through sprinkler 118. Compression portion 140 includes a connector portion 138 which extends from one side of compression portion 140 to an opposite side of compression portion 140. Connector portion 138 may have an overall U-shaped profile. Connector portion 138 connects inlet 124 to facilitate the flow of the fire suppressant agent from inlet 124 into an inner volume of compression portion 140.

Compression portion 140 includes an inner volume for compression of the fire suppressant agent flowing through body 130. The inner volume and overall shape of compression portion 140 may be conical. For example, the inner volume may have a circular cross section which decreases along a length of compression portion 140. Compression portion 140 decreases in diameter until it is substantially equal in diameter to constricted portion 142. In an exemplary embodiment, compression portion 140 and constricted portion 142 are integrally formed. For example, compression portion 140, constricted portion 142 and expansion portion 144 may form the majority of body 130. Compression portion 140, constricted portion 142, and expansion portion 144 may all be integrally formed to form a venturi.

Figure 5:
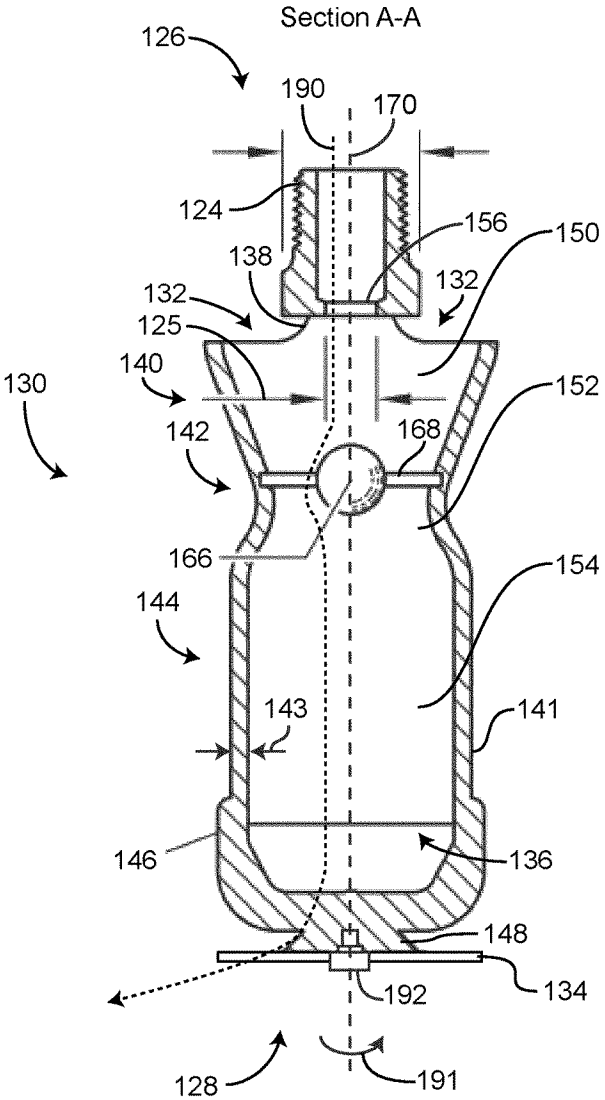
FIG. 5 is a side cross-sectional view of one of the sprinklers of FIG. 1, including a vane deflector, according to some embodiments.
Figure 4:
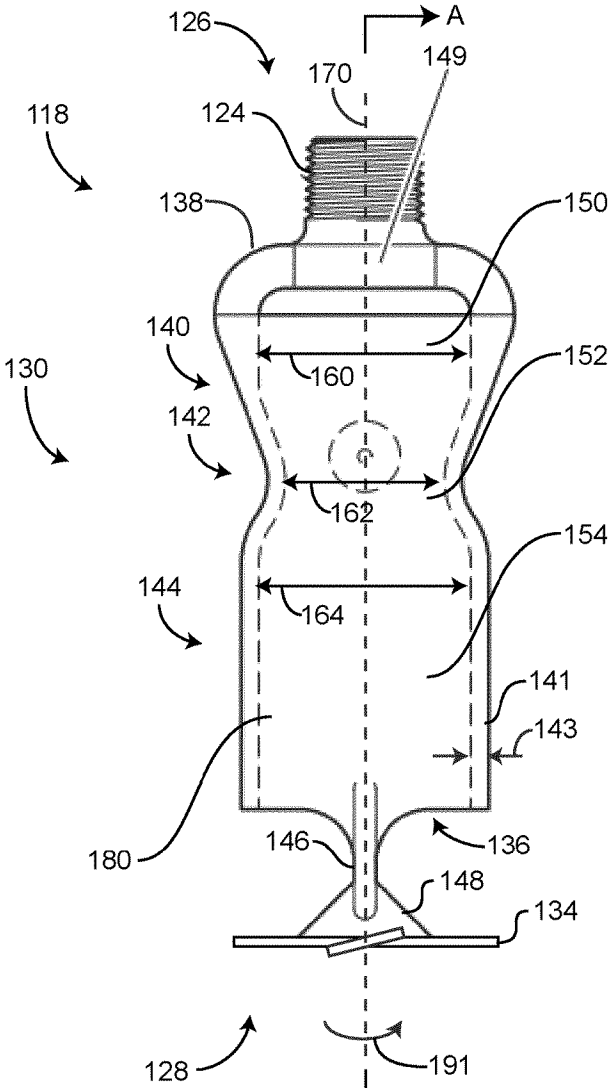
FIG. 4 is a side cross-sectional view of one of the sprinklers of FIG. 1, including a vane deflector, according to some embodiments.

Constricted portion 142 has an aperture or inner volume therewithin configured to facilitate the flow of fire suppressant agent therethrough. Constricted portion 142 has a minimum inner diameter of portions 140, 142, and 144. Constricted portion 142 may include an agitator (i.e., agitator 166 as shown in FIGS. 4-5) therewithin. The agitator is configured to agitate the fire suppressant agent passing through constricted portion 142. Constricted portion 142 having the minimum diameter of portions 140, 142, and 144 may produce a lowered pressure at constricted portion 142. The lowered pressure at constricted portion 142 may draw air from the environment into body 130 of sprinkler 118 through air inlets 132. For example, the pressure at constricted portion 142 may be lower than an atmospheric pressure which may cause air to flow into inner volume 150 of compression portion 140 (see FIGS. 4-5) through air inlet 132.

Expansion portion 144 includes an inner volume having a diameter greater than the minimum diameter of constricted portion 142. Expansion portion 144 is configured to provide the fire suppressant agent to splitter 148. Splitter 148 is conical shaped and is configured to disperse the fire suppressant agent provided through expansion portion 144 in a conical flow path. The fire suppressant agent may impinge along splitter 148 such that it is evenly distributed about and provided to deflector 134. Splitter 148 may facilitate a uniform spread of the fire suppressant agent to deflector 134. Splitter 148 is positioned in the fluid flow path of fire suppressant agent exiting expansion portion 144 through outlet aperture 136. Splitter 148 may be integrally formed with connector 146. Connector 146 extends from one side of expansion portion 144 to the other side of expansion portion 144 and positions splitter 148 in the fluid path of the fire suppressant agent exiting expansion portion 144 through outlet aperture 136. Connector 146 may be referred to as "support arms" which extend at outlet end 128 of sprinkler 118.

Referring now to FIGS. 4-5, sprinkler 118 is shown in greater detail, according to an exemplary embodiment. FIG. 4 shows a front view of sprinkler 118. FIG. 5 shows a cross-sectional side view of sprinkler 118 in a plane which is 90 degrees about a central axis 170 (e.g., a longitudinal axis) of sprinkler 118 relative to the front view as shown in FIG. 4. Central axis 170 extends longitudinally through a center of sprinkler 118. As shown in FIGS. 4 and 5, inlet 124, compression portion 140, constricted portion 142, and expansion portion 144 are all centered about central axis 170. Additionally, splitter 148 and deflector 134 are centered on central axis 170.

As shown in FIGS. 4 and 5, connector portion 138 and connector 146 are rotationally offset 90 degrees relative to each other about central axis 170. Therefore, the view shown in FIG. 4 illustrates a side view of connector 146 and a front view of connector portion 138, while the view shown in FIG. 5 illustrates a front sectional view of connector 146 and a side sectional view of connector portion 138.

Referring still to FIGS. 4-5, compression portion 140 includes inner volume 150, having diameter 160. In an exemplary embodiment, diameter 160 is variable with respect to longitudinal length of compression portion 140 along central axis 170, as shown in FIG. 5. Constricted portion 142 includes inner volume 152 having diameter 162. Expansion portion 144 includes inner volume 154 having diameter 164. Diameter 164 of expansion portion 144 may initially be substantially equal to diameter 162 of constricted portion 142 and may increase along at least a portion of central axis 170. Diameter 164 of expansion portion 144 may be substantially constant along at least a second portion of central axis 170. Inner volumes 150, 152, and 154 define inner volume 180 of sprinkler 118 to facilitate the flow of fire suppressant agent therethrough body 130 from inlet end 126 of sprinkler 118 to outlet end 128 of sprinkler 118. Inner volume 180 of body 130 of sprinkler 118 decreases in diameter along compression portion 140, is at a minimum diameter value at constricted portion 142, and then increases and remains constant along expansion portion 144. Constricted portion 142 includes agitator 166 which is positioned at a central point of connector 168. Connector 168 extends from wall 141 at one side of constricted portion 142 to wall 141 at an opposite side of constricted portion 142. In an exemplary embodiment, connector 168 and therefore agitator 166 pass through central axis 170 of sprinkler 118.

Inner volume 180 of sprinkler 118 defines flow path 190 from inlet 124 to outlet end 128. Fire suppressant agent may flow along flow path 190. As shown in FIG. 5, flow path 190 illustrates fire suppressant agent entering inlet 124 from piping system 110, passing through inner volume 150 of compression portion 140, passing through inner volume 152 of constricted portion 142 and around agitator 166, and through inner volume 154 of expansion portion 144. Flow path 190 illustrates fire suppressant agent exiting body 130 through outlet aperture 136. After the fire suppressant agent exits body 130 through outlet aperture 136, the fire suppressant agent is distributed, spread, deflected, etc., by splitter 148. The fire suppressant agent then passes over deflector 134 which directs, diffuses, spreads, etc., the fire suppressant agent radially outwards from central axis 170 at a velocity v. Air may be drawn into body 130 through air inlet 132 due to a lowered pressure within inner volume 180 of body 130. The air and the fire suppressant agent may mix within inner volume 180 of body 130, such that any fire suppressant agent flowing along flow path 190 after the introduction of air is aerated fire suppressant agent. Therefore, the fire suppressant agent passing though constricted portion 142, and any other portions of sprinkler 118 downstream from air inlet 132 is aerated.

Deflector 134 is configured to distribute the aerated fire suppressant agent to an area, space, surface, etc., for fire suppression. Deflector 134 may be fixed to splitter 148. In an exemplary embodiment, deflector 134 is rotatably coupled to splitter 148. Deflector 134 may rotate about central axis 170 in direction 191, or in a direction opposite direction 191, according to an exemplary embodiment. Deflector 134 is configured to rotate in response to fire suppressant agent and/or air passing over at least a portion of deflector 134. Deflector 134 may be rotatably coupled to splitter 148 via fastener 192. In an exemplary embodiment, fastener 192 is a shoulder bolt, such that fastener 192 can be tightened while still facilitating rotation of deflector 134. Fastener 192 may be configured to threadingly interface with an inner periphery of an aperture of splitter 148.

Sprinkler 118 as shown in FIGS. 2-5 may be a modified version of a B-1 foam sprinkler head. Sprinkler 118 may be configured as a pendant sprinkler or an upright sprinkler, or a side mounted sprinkler. In an exemplary embodiment, sprinkler 118 has a K-factor of greater than 3.0. Sprinkler 118 may be configured to operate at an operating pressure of less than 30 psi. Sprinkler 118 may have an increased orifice diameter 125 relative to other B-1 foam sprinkler heads. Advantageously, sprinkler 118 has a K-factor of greater than 3, can operate at low pressures, and aerates the fire suppressant agent entering sprinkler 118. Deflector 134 is configured to spread the fire suppressant agent such that four of sprinkler 118 can distribute the fire suppressant agent over a 100 square foot area or greater (e.g., a 150 square foot area).

Figure 6A:
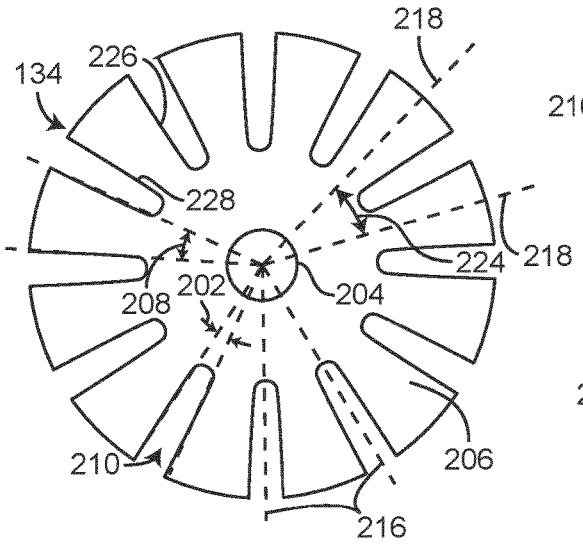
FIG. 6A is a top view of the vane deflector of FIGS. 4-5 of the sprinkler of FIG. 1, according to some embodiments.
Figure 6B:
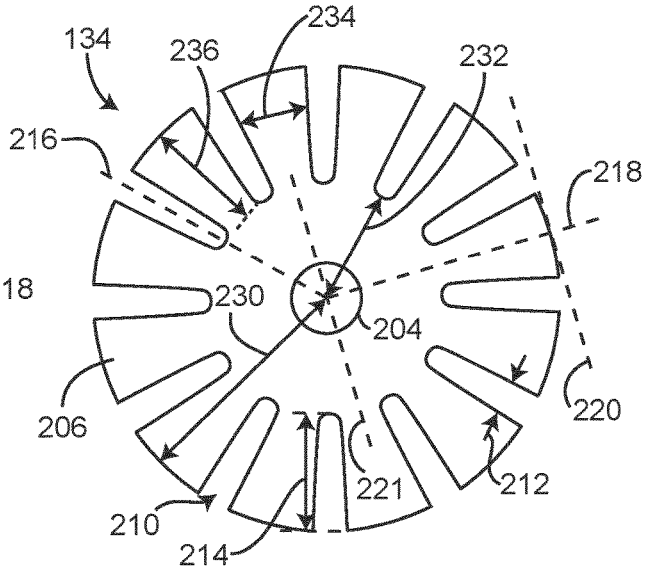
FIG. 6B is a top view of the vane deflector of FIGS. 4-5 of the sprinkler of FIG. 1, according to some embodiments.
Figure 7:
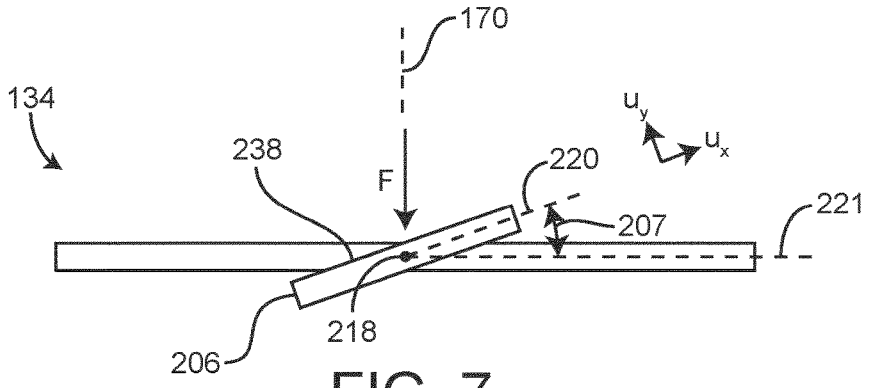
FIG. 7 is a side view of the vane deflector of FIGS. 4-5 of the sprinkler of FIG. 1, showing a tine of the vane deflector at an angle.

Referring now to FIGS. 6A-7, deflector 134 is shown in greater detail, according to an exemplary embodiment. Deflector 134 includes central aperture 204. Central aperture 204 is configured to interface with fastener 192 (shown in FIG. 5) to facilitate the rotatable connection (or fixed connection) between deflector 134 and splitter 148. In some embodiments, central aperture 204 is centrally located on deflector 134. In other embodiments, central aperture 204 is offset (e.g., radially and angularly) from a center point of deflector 134.

Deflector 134 includes tines 206 and slits 210. As shown in FIGS. 6A-6B, deflector 134 includes twelve tines 206 and twelve slits 210. Slits 210 are disposed between angularly neighboring tines 206. While twelve tines 206 and slits 210 are shown in FIGS. 6A-6B, any number of tines 206 and slits 210 may be used. Various embodiments may include any number from 2 to 30 tines 206 and slits 210 (or over 30 tines and over 30 slits 210). For example, one embodiment may have 15 tines 206 and slits 210, while another embodiment may have 25 tines 206 and slits 210. The size, angle, and spacing of tines 206 can be adjusted to control a pattern of the fire suppressant agent (e.g., aerated fire suppressant agent, foam, etc.) emitted by sprinkler 118 at outlet end 128.

Tines 206 extend radially outwards from a center of deflector 134. Tines 206 extend along radial centerline 218 (e.g., a radially extending axis). In some embodiments, each radial centerline 218 extends along a plane that is perpendicular to or substantially perpendicular to central axis 170. Tines 206 as described herein may be angled, twisted, bent, etc., relative to the plane that radial centerline 218 extends through. In some embodiments, radial centerline 218 extends in a direction that is substantially perpendicular to or orthogonal to central axis 170. Likewise, slits 210 extend radially outwards from the center of deflector 134 along radial centerlines 216. In some embodiments, each tine 206 extends along a corresponding radial centerline 218. Angle 224 is defined between neighboring radial centerlines 218 of tines 206. Likewise, angle 222 is defined between radially neighboring centerlines 216 of slits 210. Angles 222 and 224 depend on a number of tines 206 and slits 210 present on deflector 134. For example, if twelve tines 206 and twelve slits 210 are present on deflector 134, angles 222 and 224 are 360/12=30°. Likewise, if ten tines 206 and ten slits 210 are present on deflector 134, angles 222 and 224 are 360/10=36°. In an exemplary embodiment angles 222 and 224 are substantially equal. In other embodiments, angles 222 and 224 are non-equal.

Tines 206 are each defined by a first edge 226 and a second edge 228. First edge 226 extends along a first radial centerline and second edge 228 extends along a second radial centerline. The first radial centerline and the second radial centerline are disposed an angle 208 apart. In an exemplary embodiment, tines 206 are sectors of an annulus defined by a first radius 232 and a second radius 230. The second radius 230 is a radial distance between the center of deflector 134 and an outer periphery of deflector 134. The first radius 232 is a radial distance between the center of deflector 134 and a starting point of slits 210 (i.e., a radially most-inward edge or surface of slits 210). Tines 206 are defined as a sector of the annulus defined by radius 232 and 230 having angle 208 relative to the center of deflector 134. Likewise, slits 210 are defined as sectors of the annulus defined by radius 232 and 230 having angle 202 relative to the center of deflector 134. Angle 208 may be referred to as $\theta_{tine}$ and angle 202 may be referred to as $\theta_{slit}$. The area of each tine 206, $A_{tine}$ and the area of each slit 210, $A_{slit}$, may be determined using the equations:

$$A_{tine} = \frac{(R^2 - r^2)\cdot\pi\cdot\theta_{tine}}{360}$$

$$A_{slit} = \frac{(R^2 - r^2)\cdot\pi\cdot\theta_{slit}}{360}$$

where R is radius 230, r is radius 232, $\theta_{tine}$ is angle 208, and $\theta_{slit}$ is angle 202.

It should be noted that the above equations only apply when tines 206 and slits 210 are sectors of an annulus. The areas of tines 206 and slits 210 may be changed by changing the values of radius 232. Radius 230 may also be adjusted. In other embodiments, radius 230, which is the radial distance between the center of deflector 134 and the outer periphery of deflector 134 is constant. For example, an overall size and shape of deflector 134 may remain constant with the size, number, and shape of tines 206 and slits 210 being adjusted. In an exemplary embodiment, each of tines 206 and slits 210 have a uniform size and shape. In other embodiments, the size and shape of tines 206 and/or slits 210 varies (e.g., a first tine 206 has a first area, a second tine 206 has a second area greater than or less than the first area, etc.). For example, in other embodiments, tines 206 and slits 210 are rectangular, having parallel edges (e.g., edge 226 and edge 228 of each tine 206 are parallel).

Referring still to FIGS. 6A-7, tines 206 have an overall radial length 236 and a width 234. Radial length 236 of tines 206 extends along radial centerline 218 which radially extends from the center of deflector 134 through a center of tine 206. Radial length 236 may be the difference between radius 230 and radius 232. Width 234 is measured at various positioned along radial length 236 in a direction perpendicular to radial centerline 218. Width 234 extends between first edge 226 and second edge 228 of the corresponding tine 206. Width 234 is shown increasing at further radial distances along radial centerline 218 of tine 206. For example, width 234 has a minimum value at a radial distance of radius 232 along radial centerline 218, and a maximum value at a radial distance of radius 230 along radial centerline 218. In other embodiments, width 234 decreases with respect to increasing radial distance along radial centerline 218 of tine 206. In other embodiments, width 234 of certain tines 206 increases with respect to increasing radial distance along radial centerline 218, while width 234 of other tines 206 decreases with respect to increasing radial distance along radial centerline 218.

Likewise, slits 210 have an overall radial length 214 and a width 212. Radial length 214 of slits 210 extends along radial centerline 216 which radially extends from the center of deflector 134 through a center of slit 210. Radial length 214 may be the difference between radius 230 and radius 232. Width 212 is measured at various positions along radial length 214 in a direction perpendicular to radial centerline 216. Width 212 extends between a first edge and a second edge of the corresponding slit 210. Width 212 is shown increasing at further radial distances along radial centerline 216 of tine 206. For example, width 212 has a minimum value at a radial distance of radius 232 along radial centerline 216, and a maximum value at a radial distance of radius 230 along radial centerline 216. In other embodiments, width 212 decreases with respect to increasing radial distance along radial centerline 216 of slit 210. In other embodiments, width 212 of certain slits 210 increases with respect to increasing radial distance along radial centerline 216, while width 212 of other slits 210 decreases with respect to increasing radial distance along radial centerline 216.

Referring now to FIGS. 6A-6B and 7, tines 206 are shown to include a centerline 221 extending tangentially through tine 206. FIG. 7 shows a side view of deflector 134 along radial centerline 218. As shown in FIG. 7, tines 206 are angled relative to a horizontal tangential centerline 221. Tines 206 may be twisted along a radial length of tines 206. In other embodiments, tines 206 are angled at angle 207 at a certain radial position along tines 206. Angle 207 is defined between tangential centerline 220 and horizontal tangential centerline 221. Tangential centerline 220 is perpendicular to radial centerline 218 and extends tangentially through the center of tine 206. In an exemplary embodiment, angle 207 is a value between 1 degree and 45 degrees. In other embodiments, angle 207 is greater than 45 degrees. Angle 207 of each tine 206 may be uniform (e.g., each tine 206 has an angle 207 equal to 10 degrees), while in other embodiments, angles 207 of tines 206 varies. For example, certain tines 206 may have an angle 207 of 10 degrees, while other tines 206 may have an angle 207 of 20 degrees. In some embodiments, angle 207 is 23.3 degrees. In other embodiments, angle 207 is 10.5 degrees.

As shown in FIG. 7, when a force F is exerted on tine 206 due to fire suppressant agent flowing through sprinkler 118, angle 207 affects an amount of force that causes deflector 134 to rotate. Force F can be reduced into forces in direction $u_x$ (acting along surface 238 of tine 206), $F_x$, and in direction $u_y$, $F_y$ (perpendicular to surface 238 of tine 206). In some embodiments, angle 207 is proportional to the force transferred to deflector 134 that causes deflector 134 to rotate. Additionally, an amount of surface area exposed to the forces or pressures due to the flow of fire suppressant agent through sprinkler 118 may affect the amount of force which is transferred into the angular rotation of deflector 134. Since the dimensions and size of tine 206 affects the amount of surface area of each tine 206 exposed to the fire suppressants agent, the dimensions, size, and number of tines 206 may affect the amount of force which is transferred into the angular rotation of deflector 134. Likewise, forces applied to the surface of tines 206 at a further radial distance along radial centerline 218 produce a larger torque about central axis 170 which results in a faster acceleration and/or faster angular speed of deflector 134.

Deflector 134 is configured to spread the aerated fire suppressant agent evenly about a space for fire suppression purposes. The value of angle 207, the size, shape, and number of tines 206, as well as the shape and size of slits/slots 210 can be controlled or adjusted to achieve a desired expansion of the aerated fire suppressant agent and/or to achieve a desired range of fire suppressant agent emitted from sprinkler 118 at outlet end 128. Deflector 134 may be configured to rotatably connect to splitter 148 such that deflector 134 can spin freely, or may be fixed to splitter 148 (e.g., solidly mounted).

Figure 10:
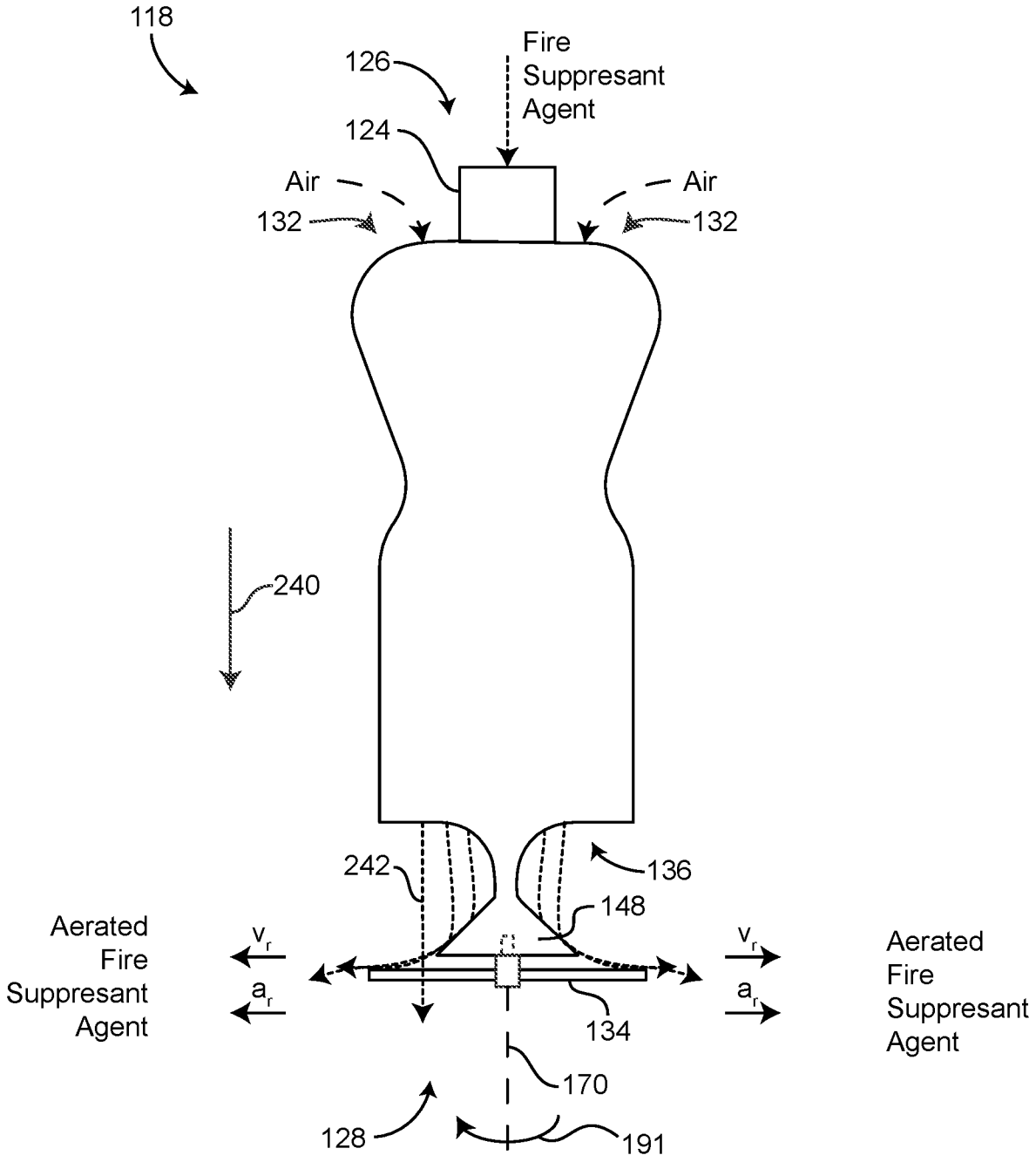
FIG. 10 is a side view of the sprinkler of FIG. 1, receiving fire suppressant agent through an inlet and air through air inlets, and outputting aerated fire suppressant agent, according to some embodiments.

Fire suppressant agent may contact surface 238 of one or more of tines 206. When the fire suppressant agent contacts surface 238 of one or more tines 206, the fire suppressant agent may be accelerated (e.g., directed, flung, etc.) radially outwards from central axis 170 of deflector 134 due to rotation of deflector 134. As deflector 134 rotates faster (e.g., due to different geometry, orientation of tines 206, etc.), the fire suppressant agent is accelerated radially outwards from central axis 170 along surface 238 of the one or more of tines 206 at a higher value. For example, as shown in FIG. 10, fire suppressant agent enters sprinkler 118 at inlet end 126 via inlet 124 and exits sprinkler 118 at outlet end 128 via outlet aperture 136. The fire suppressant agent may be directed via splitter 148 to deflector 134. Deflector 134 may facilitate directing, accelerating, etc., the fire suppressant agent radially outwards from central axis 170 at speedy $v_r$ with acceleration $a_r$.

Deflector 134 may rotate due to the fire suppressant agent passing over tines 206 which may increase the radial speed $v_r$ and radial acceleration $a_r$ at which the fire suppressant agent leaves deflector 134 radially outwards from central axis 170. Advantageously, increasing the radial speed and/or the radial acceleration at which the fire suppressant agent leaves deflector 134 may result in a larger area over which the fire suppressant agent falls. For example, the fire suppressant agent may be accelerated radially outwards from central axis 170 due to the rotation of the deflector 134. Some of the fire suppressant agent may pass through slits 210 and fall in a direction 240 straight down (e.g., as illustrated by fluid flow path 242 shown in FIG. 10). However, the majority of the fire suppressant agent is distributed radially outwards due to splitter 148 and/or deflector 134. The velocity $v_r$ may be proportional to angular acceleration a and the angular velocity $\omega$ of deflector 134, such that $v_r$ is proportional to $\omega$ and $\alpha$, and a is proportional to $\omega$ and $\alpha$. As described above the angular velocity $\omega$ of distributer (and likewise the angular acceleration $\alpha$) are related to the geometry, configuration, and angulation of tines 206 and/or slits 210. Therefore, the geometry, configuration, angulation, etc., of tines 206 and/or slits 210 can be adjusted to maximize $v_r$ and/or $a_r$ to increase spread of the fire suppressant agent leaving sprinkler 118.

Tines 206 can be angled, twisted, or bent. For example, tines 206 can be bent downwards (or possibly upwards) an angular amount. Tines 206 may be bent downwards at first radius 232. For example, in some embodiments, tines 206 are bent downwards 10.5 degrees relative to a generally flat central portion of deflector 134 (e.g., the area of deflector 134 that is within first radius 232).

Figure 8:
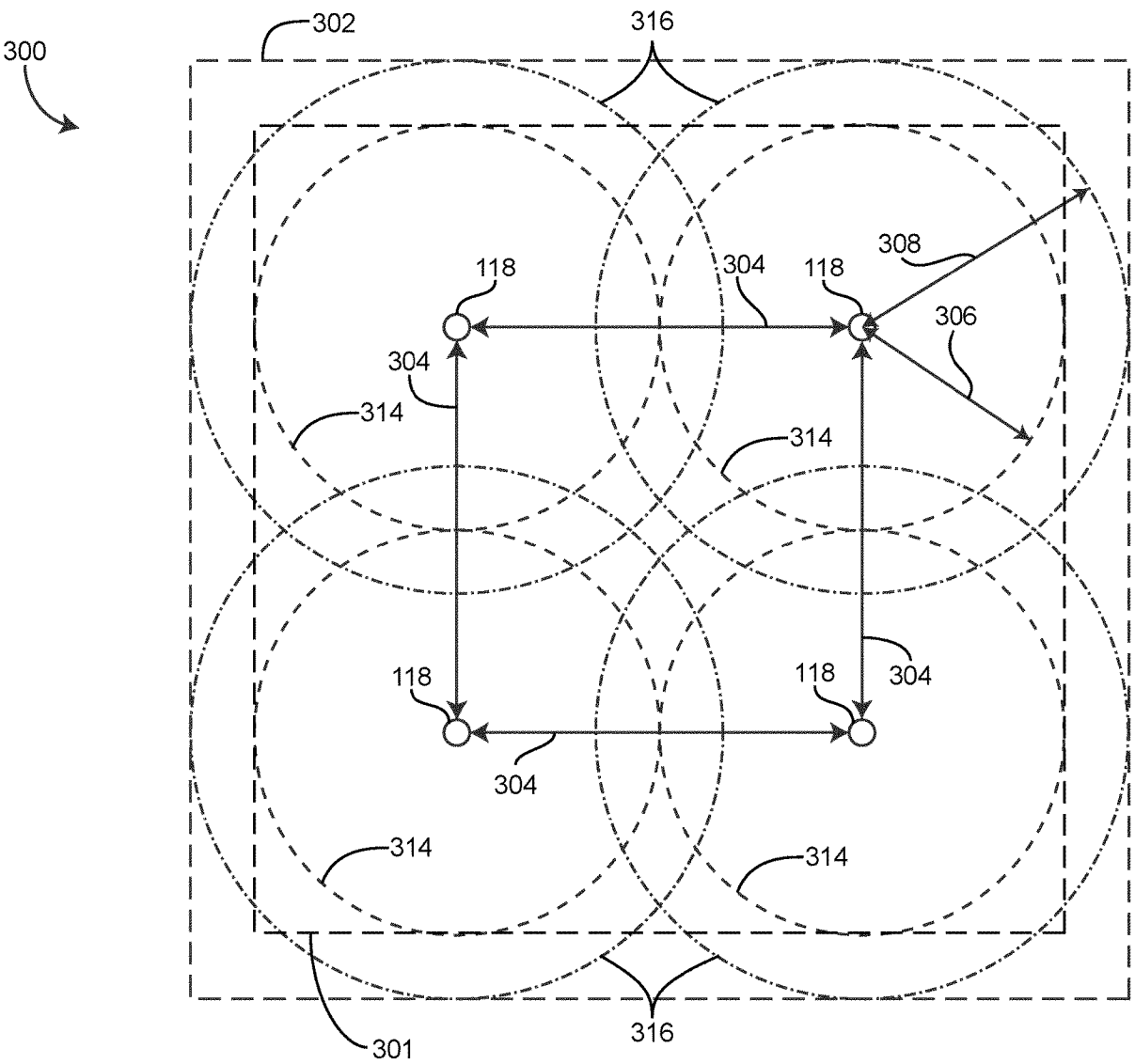
FIG. 8 is a top view diagram illustrating an increased spread and service area of fire suppressant agent emitted by the sprinkler of FIG. 1, according to some embodiments.

Referring now to FIG. 8, diagram 300 illustrates the spread of fire suppressant agent distributed by multiple sprinkler 118, according to an exemplary embodiment. As shown in diagram 300, four sprinklers 118 are used to cover an area for fire suppression. The area which the four sprinkler 118 cover may be an area where a fire may occur (e.g., a building space, a vehicle, an engine room, a boiler room, a barn, an outdoor structure, etc.). Diagram 300 illustrates the advantages of using a rotatable deflector 134 to increase an overall spread of sprinklers 118. Increasing the spread or coverage area of each sprinkler 118 advantageously facilitates using less sprinklers to cover a same amount of area. Using less sprinklers can save fire suppression system manufacturers, building manufacturers, etc., as well as customers cost-savings, since the same area can be serviced (e.g., fire-suppressed) with a lower amount of sprinklers, as compared to sprinklers 118 which do not use a rotatable deflector 134. Diagram 300 illustrates the advantages of using a fixed or rotatable vane deflector (with twisted and/or bend tines). The angle, twist, bend, etc., of tines 206 can be adjusted to achieve higher flow rate and lower expansion of the fire suppressant agent, or to achieve lower flow rate and higher expansion of the fire suppressant agent. In this way, sprinklers 118 provide additional degrees of controllability and can be used to achieve desired flow rate and desired fire suppressant agent expansion. Diameter 125 of orifice 156 can be adjusted (e.g., increased or decreased) to change the K-factor of sprinkler 118 (e.g., to increase or decrease the K-factor).

As shown in diagram 300, sprinklers 118 can increase an amount of service area by using a rotatable deflector 134. Each of sprinklers 118 are shown having a spread area 314 when deflector 134 is not used. Each spread area 314 is shown as a circular area. Spread areas 314 may substantially be a circular area. Spread area 314 has radius 306. Sprinklers 118 are each disposed in a substantially square or rectangular pattern a distance 304 apart. When deflector 134 is not used, the four sprinklers 118 each spread fire suppressant agent about spread areas 314 and may be used to service (e.g., provide fire suppression to) service area 301. Service area 301 encompasses substantially all of spread areas 314. However, when deflector 134 is used (e.g., rotatable or fixed), as described in greater detail above with reference to FIGS. 1-7 and 10, each of sprinklers 118 can provide fire suppressant agent to spread areas 316 having a radius 308. As shown in FIG. 8, radius 308 which corresponds to sprinklers 118 using a rotatable deflector 134 is greater than radius 306 which corresponds to sprinklers 118 which do not use a rotatable deflector 134 (e.g., use a deflector other than deflector 134 or no deflector 134). Therefore, spread area 316 of each sprinkler 118 is increased, and the overall service area 302 is also increased (e.g., service area 302 is greater than service area 301 and spread area 316 of each sprinkler 118 is greater than spread area 314).

Figure 9:
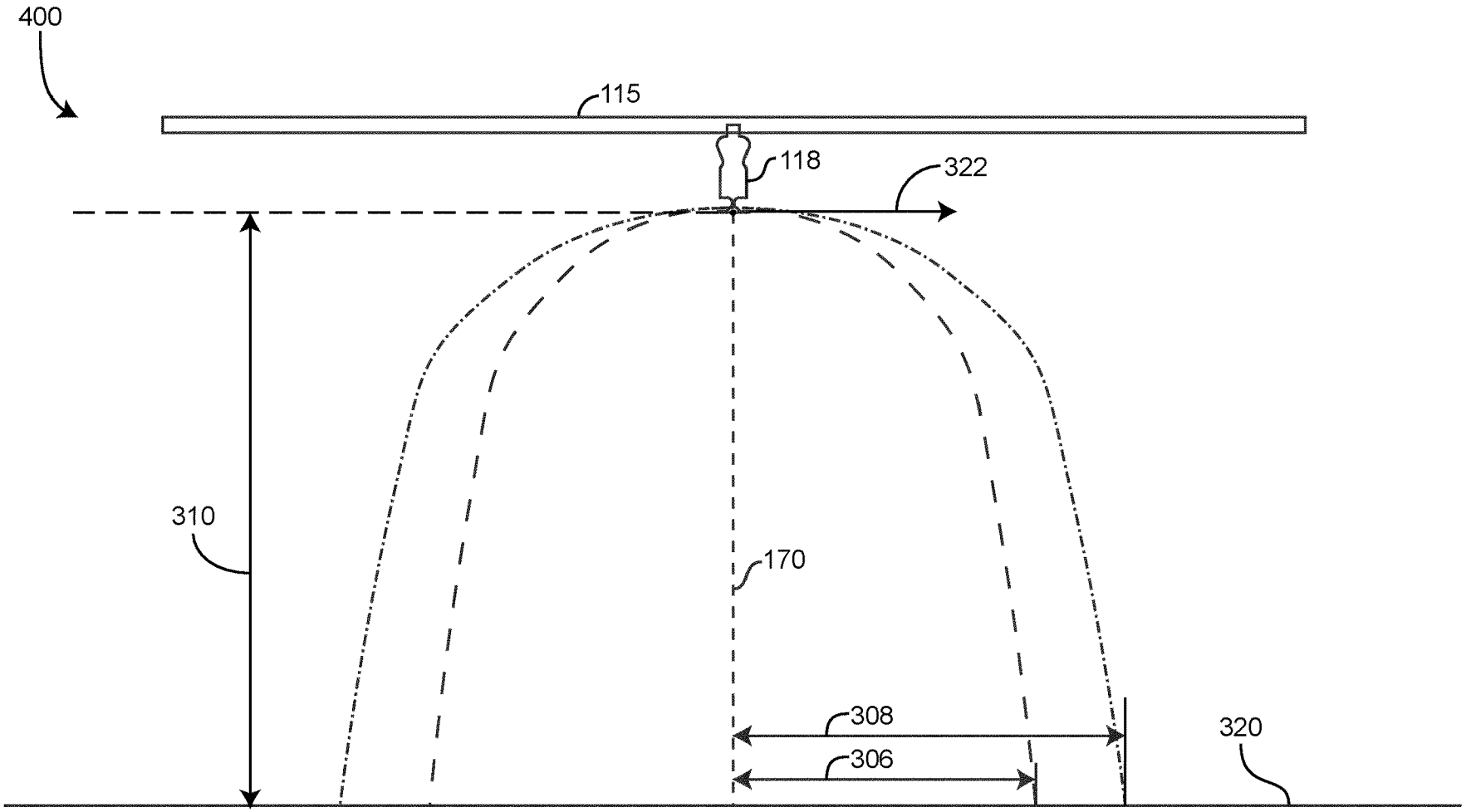
FIG. 9 is a side view diagram illustrating an increased spread and service area of fire suppressant agent emitted by the sprinkler of FIG. 1, according to some embodiments.

Spread area 316 of each sprinkler 118 may increase due to an increased velocity $v_r$ and/or acceleration $a_r$ at which the fire suppressant agent leaves sprinkler 118 at deflector 134. As shown in FIG. 9, diagram 400 illustrates the effect of increased velocity and/or acceleration of the fire suppressant agent leaving sprinkler 118. Diagram 400 illustrates a single sprinkler 118 fluidly coupled to pipe 115. Pipe 115 provides sprinkler 118 with fire suppressant agent at a pressure p. The pressure p at which the fire suppressant agent is provided to sprinkler 118 may determine a speed at which the fire suppressant agent enters sprinkler 118 and therefore the overall spread area over which the fire suppressant agent is distributed by sprinkler 118. Sprinkler 118 is shown disposed a vertical distance 310 from ground surface 320. Ground surface 320 may be an area over which fire suppression is to be provided by sprinkler 118. Radius 306 indicates a radial distance from central axis 170 which the fire suppressant agent is at when it contacts ground surface 320 for a sprinkler 118 which does not use a rotatable deflector 134.

Radius 308 indicates a radial distance from central axis 170 which the fire suppressant agent is at when it contacts ground surface 320 for a sprinkler 118 which uses the rotatable deflector 134 as described in greater detail hereinabove. As shown from diagram 400, radius 308 is greater than radius 306. This is due to the increased radial velocity $v_r$ and/or the increased radial acceleration $a_r$ of the fire suppressant agent when it leaves sprinkler 118. The radial velocity $v_r$ and the radial acceleration $a_r$ of the fire suppressant agent when it leaves sprinkler 118 is increased due to the rotation of deflector 134 (e.g., due to the angular velocity $\omega$ and/or the angular acceleration a of deflector 134). When the fire suppressant agent leaves sprinkler 118 along surface 238 of deflector 134, both the radial velocity $v_r$ and the radial acceleration $a_r$ act in direction 322 which extends perpendicularly and radially outwards from central axis 170. As shown, direction 322 is substantially parallel to ground surface 320.

Once the fire suppressant agent leaves sprinkler 118, it undergoes projectile motion. The fire suppressant agent undergoes gravitational forces which cause it to fall to ground surface 320 as well as air resistance. The air resistance, as well as the density and the overall surface area (or exposed area) of each particle (e.g., droplet) of the fire suppressant agent affects radius 308. Additionally, radius 308 is affected by the value of distance 310. Increasing the radial velocity $v_r$ and/or the radial acceleration $a_r$ of the fire suppressant agent as it leaves sprinkler 118 in direction 322 increases radius 308 (e.g., as shown in the difference between radius 306 and radius 308).

Referring to FIG. 10, sprinkler 118 may aerate the fire suppressant agent which enters inlet 124 at inlet end 126. Air from space surrounding sprinkler 118 may enter sprinkler 118 at inlet end 126 through air inlets 132. The air which enters air inlets 132 at inlet end 126 may mix with the fire suppressant agent which enters sprinkler 118 at inlet end 126 via inlet 124. Any of inner volume 150, inner volume 152, and inner volume 154 (see FIGS. 4 and 5) may act as mixing chambers to sufficiently mix the fire suppressant agent that enters sprinkler 118 via inlet 124 at inlet end 126 with the air that enters sprinkler 118 via air inlets 132 at inlet end 126. Therefore, fire suppressant agent which is provided to splitter 148 and/or deflector 134 is aerated fire suppressant agent.

Advantageously, different configurations of sprinkler 118 can be used for a variety of applications. For example, some foams (e.g., fire suppressant agents) are non-fluorinated foams which require higher expansions. Some fire suppressant agents require much less pressure to fully expand. In order to account for various pressures at which the fire suppressant agent is provided to sprinkler 118 (e.g., various values of p), diameter 125 can be adjusted (e.g., increased or decreased). However, lower pressure values or increasing diameter 125 can decrease the spread and overall service area of sprinkler 118 (e.g., the area which sprinkler 118 provides the fire suppressant agent to). In order to achieve a required spread or service area of sprinkler 118, deflector 134 can be allowed rotate or can be fixed, and the number, size, shape, angle, etc., of tines 206 can be adjusted, despite lowered values of p. Advantageously, by adjusting the size, shape, number, angle, etc., of tines 206, and/or the size, shape, and number of slits 210, the shape/spread of sprinkler 118 can be adjusted (e.g., increased or decreased as desired). The K-factor of sprinkler 118 can be adjusted (e.g., increased or decreased) by adjusting diameter 125 of orifice 156. Increased K-factors can facilitate a wider service area and a wider distribution of the fire suppressant agent. Advantageously, this can reduce the number of sprinklers 118 required for an area, and can reduce costs associated with purchase and installation of sprinklers 118.

Configuration of Exemplary Embodiments

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit and/or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the fire suppression system as shown in the various exemplary embodiments is illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

Additionally, any element disclosed in one embodiment may be incorporated or utilized with any other embodiment disclosed herein. For example, the angled tines 206 of the exemplary embodiment described in at least paragraph [0063] may be incorporated in the fire suppression system 100 of the exemplary embodiment described in at least paragraph [0037].

Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A sprinkler configured to distribute a fire suppressant agent, the sprinkler comprising:

an inlet aperture configured to receive fire suppressant agent at an inlet end of the sprinkler;

an outlet aperture at an outlet end of the sprinkler;

a body extending along a longitudinal axis, the body comprising an inner volume that forms a fluid flow path between the inlet end and the outlet end of the sprinkler, the body defining a constricted portion;

an agitator positioned within the inner volume of the body at the constricted portion, wherein the agitator is configured to agitate the fire suppressant agent before the fire suppressant agent exits the body through the outlet aperture;

a conical member positioned at the outlet end of the sprinkler and configured to direct the fire suppressant agent outwards after the fire suppressant agent exits the outlet aperture; and a deflector configured to receive fire suppressant agent from the conical member and distribute the fire suppressant agent about a service area, the deflector comprising a plurality of tines, wherein each of the plurality of tines extends along a corresponding radial axis that is substantially perpendicular with the longitudinal axis, the corresponding radial axes extending radially outwards from the longitudinal axis, wherein each tine is offset by an angular amount about the corresponding radial axis.

2. The sprinkler of claim 1, wherein the deflector is fixedly coupled with the conical member at a base of the conical member and the plurality of tines are configured to receive the fire suppressant agent and direct the fire suppressant agent radially outwards to distribute the fire suppressant agent about the service area.

3. The sprinkler of claim 1, wherein the deflector is rotatably coupled with the conical member at a base of the conical member.

4. The sprinkler of claim 3, wherein the plurality of tines of the deflector are configured to receive the fire suppressant agent as the fire suppressant agent flows along the fluid flow path to drive the deflector to rotate about the longitudinal axis.

5. The sprinkler of claim 1, wherein the conical member is configured to receive the fire suppressant agent from the outlet aperture of the sprinkler at the outlet end of the sprinkler, and distribute the fire suppressant agent about the deflector.

6. The sprinkler of claim 1, wherein the deflector further comprises a plurality of slots, wherein each slot is positioned between neighboring tines.

7. The sprinkler of claim 1, wherein the plurality of tines are each angled between 1 and 45 degrees about the corresponding radial axis.

8. The sprinkler of claim 1, wherein the plurality of tines are each twisted about the corresponding radial axis along a radial length of the plurality of tines.

9. The sprinkler of claim 1, wherein the conical member is fixedly coupled with a connecting portion of the sprinkler at an apex of the conical member, wherein the connecting portion is fixedly coupled with and extends between two points of the body at the outlet end of the sprinkler.

10. The sprinkler of claim 1, wherein the conical member and the deflector are positioned downstream of the outlet aperture of the sprinkler.

* * * * *